United States Patent [19]

Kerber

[11] 4,270,457

[45] Jun. 2, 1981

[54] STAGGERED ACCESS TO ENDLESS LOOP CABLE TRANSIT SYSTEMS

[76] Inventor: David Kerber, 168 Beach 140 St., Belle Harbor, N.Y. 11694

[21] Appl. No.: 44,199

[22] Filed: May 31, 1979

[51] Int. Cl.[3] ..... B61B 9/00; B61B 13/14

[52] U.S. Cl. ..... 104/25; 104/173 R

[58] Field of Search ..... 104/18, 20, 25, 88, 104/173 R; 198/321

[56] References Cited

U.S. PATENT DOCUMENTS

| | | | |
|---|---|---|---|
| 1,001,170 | 8/1911 | Sayer | 104/18 |
| 2,802,427 | 8/1957 | Da Costa | 104/18 |
| 3,057,487 | 10/1962 | Martinez | 104/25 X |
| 3,421,450 | 1/1969 | Bell | 104/20 |
| 3,433,176 | 3/1969 | Fujita | 104/25 X |
| 3,861,317 | 1/1975 | Crowder | 104/18 X |
| 4,071,135 | 1/1978 | Ishikawa et al. | 104/18 X |

FOREIGN PATENT DOCUMENTS

| | | | |
|---|---|---|---|
| 52-25311 | 2/1977 | Japan | 104/18 |

*Primary Examiner*—Randolph A. Reese

[57] ABSTRACT

A method of access to a transportation system in which an endless cable pulls a series of transport modules in an endless loop is described. A single loop stops alternately at short and long intervals to combine in a single loop the advantages of separate local and express loops. The user combines the long and short distances, getting off and waiting if necessary, to get closest to his destination while making the fewest stops.

1 Claim, 3 Drawing Figures

STAGGERED ACCESS TO ENDLESS LOOP CABLE TRANSIT SYSTEMS

References Cited

U.S. Pat. Nos. 2,044,134—6/1936—Storer—104/25; 3,421,450—1/1969—Bell—104/20; 3,934,515—1/1976—Cushman—104/18; 3,987,734—2/1975—Horn—104/88; 3,527,169—9/1970—Bouladon—104/25; 4,057,017—11/1977—Michalon—104/20; 3,881,423—4/1974—Woods—104/25.

BACKGROUND OF THE INVENTION

Some amusement park rides use an endless cable to drive a string of cars in an endless loop. When the motor driving the cable is turned off the cars slow to a halt. Riders can then get into or out of any of the cars. However, in endless loop cable devices used for public transportation these two features—separate cars attached at intervals to and driven in an endless loop by an endless cable, and halts for access to any car—are not combined. Aerial tramways and funicular railways stop for access but are limited to only two cabins on a shuttle route. Chair lifts, surface lifts and pater nosters follow and endless loop but do not stop for access.

Patented endless loop transportation systems reject stop-and-go access as inefficient. Instead, they recommend additional hardware: secondary access loops (Storer, Bell, Cushman); shunting devices (Horn); or deceleration mechanisms (Bouladon, Michalon, Woods). Instead of cars attached only to the drive cable some of these use endless trains in which the cars are coupled directly to one another. These are cumbersome, require a great deal of hardware if they are of any length, and adjust only with difficulty to variable payloads.

SUMMARY OF THE INVENTION

An endless loop cable-driven transportation system makes use of the technique of stop-and-go access, but of a special sort called "staggered-access." A single loop stops at alternately long and short intervals. This method combines in a single loop the advantages of separate local and express loops - close access with infrequent halts. The user combines the long and short intervals, getting off and waiting if necessary, to get closest to his destination while making the fewest stops.

The staggered-access technique lets us benefit from the advantages of a stop-and-go endless loop cable system without having to use separate local and express loops. Some of these advantages are:

Any number of cabins can be attached to the cable since the distances between cabins remain constant over all phases of the access cycle.

If, as is likely, a stationary source of mechanical power is used to drive the cable, the motor and its fuel are not deadweight.

Any means of cabin suspension can be used: streetcar/rail, tire/road, platform/wheelway, hull/water, forced air or water, ski/snow, magnetic levitation, "monorail" structures with any of these, as well as combinations:

Between stops the cable accelerates the cabins to any speed appropriate to the terrain, suspension system and distances between halts.

The system has the same efficiency on grades as on level ground since all grades counter-balance, and in any weather since the wheels are not used for traction.

There are no intersections or terminals to cause reliability, scheduling or switching problems.

Safety hazards are avoided because no transfers take place while the cabins are moving.

BRIEF DESCRIPTION OF THE DRAWINGS

The present invention will become more readily apparent from the following detailed description taken in conjunction with the accompanying drawings in which.

DESCRIPTION OF THE DRAWINGS

Figure 1:
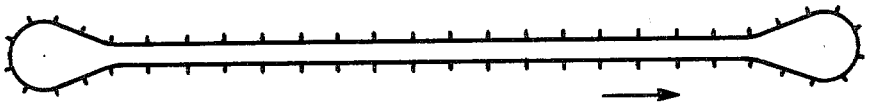
FIG. 1 shows the relative position of the rope and cabins in a single loop system.
Figure 2:
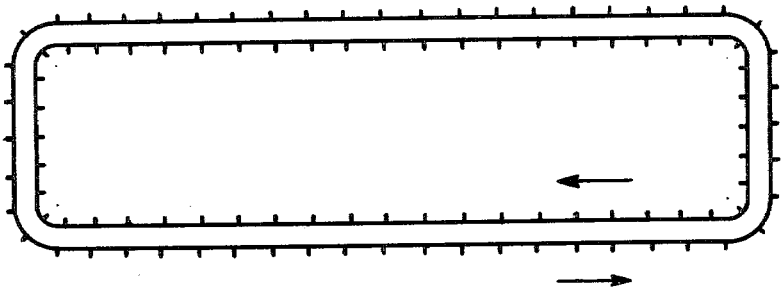
FIG. 2 shows the relative position of the rope and cabins in a dual loop system.
Figure 3:
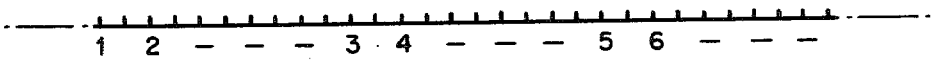
FIG. 3 shows a typical sequence of staggered-access halts.

In FIGS. 1, 2 and 3 the continuous lines represent the position of the rope or cable. The prongs indicate the position relative to the rope of the cabins or transport modules, that is, equidistant from one another. In FIG. 3 the prongs also indicate the access points to the cabins, that is, where the cabins stop to let users on and off.

FIG. 1 shows a system in which a single loop doubles back along the same path so users can have access for much of the length of the system to cabins advancing in either direction.

FIG. 2 shows a double loop system in which separate loops advance in opposite directions to provide users with access to cabins advancing in either direction at any of the access points along the entire length of the system.

FIG. 3 shows an arbitrary section of either the single or double loop systems shown in FIGS. 1 and 2. The numbers show the position after each successive halt of any arbitrarily chosen cabin relative to its former and subsequent positions. Since each access point is alternately the position of a cabin about to advance a long or short distance users can combine these distances as needed by exiting and/or waiting at their initial and/or any subsequent access point to reach the intermediate points indicated by the dashes between the numbers. When it is advantageous to do so or when their destination is unintentionally passed users can debark at the next opportunity and board the cabin advancing in the opposite direction to most nearly approach their final destination.

I claim:

1. A method of access to a transportation system in which an endless rope or cable draws a series of evenly spaced cabins or transport modules attached thereto in an endless loop comprising the steps of, (a) stopping the endless rope and attached cabins at a given location to permit passenger transfer;

(b) driving the endless rope and attached cabins a short interval to another passenger transfer location;

(c) stopping the endless rope after said short interval of travel to permit passenger transfer;

(d) driving the endless rope and attached cabins a long interval to another passenger transfer location;

(e) stopping the endless rope after said long interval of travel to permit passenger transfer;

(f) repeating steps (b)-(e).

* * * * *